US005179739A

United States Patent [19]

Mann

[11] Patent Number: 5,179,739

[45] Date of Patent: Jan. 19, 1993

[54] WATER CONSERVING TOILET ASSEMBLY

[76] Inventor: Thomas A. Mann, 73 Husford Ave., Leonardo, N.J. 07737

[21] Appl. No.: 622,192

[22] Filed: Dec. 5, 1990

Related U.S. Application Data

[63] Continuation of Ser. No. 367,229, Jun. 14, 1989, abandoned.

[51] Int. Cl.[5] ..... E03D 1/00; E03D 1/34

[52] U.S. Cl. ..... 4/378; 4/415; 4/379; 4/382; 4/385; 4/387; 137/410; 137/425; 137/391

[58] Field of Search ..... 4/378–382, 4/385–389, 393, 415, 325, 395, 366, 367, 392; 137/410, 425, 391

[56] References Cited

U.S. PATENT DOCUMENTS

| | | | |
|---|---|---|---|
| 337,353 | 3/1886 | Jacob | 4/382 |
| 381,911 | 5/1888 | Crawford | 4/386 |
| 1,110,432 | 9/1914 | Fraser | 137/425 |
| 1,581,011 | 4/1926 | North | 4/381 |
| 2,773,268 | 12/1956 | Hurko et al. | 4/393 |
| 3,142,846 | 8/1964 | Lackenmaier et al. | 4/393 |
| 3,936,889 | 2/1976 | Wibroe | 4/325 |
| 4,080,669 | 3/1978 | Biggerstaff | 4/393 |
| 4,110,849 | 9/1978 | LaFaver | 4/378 |
| 4,134,165 | 1/1979 | Phripp et al. | 4/379 |
| 4,351,071 | 9/1982 | Clar | 4/381 |
| 4,365,365 | 12/1982 | Antunez | 4/378 |

*Primary Examiner*—Henry J. Recla
*Assistant Examiner*—Keith Kupferschmid
*Attorney, Agent, or Firm*—John P. Halvonik

[57] ABSTRACT

A toilet flushing apparatus designed to prevent excess loss of water that may happen when the flush valve stays open as the inlet valve is putting water into the tank. The initial flushing lifts the flush valve which acts in conjunction with a counter-weight and controller arm attached to the float ball arm. The controller arm supports the float ball and thus allows the intake valve to remain in the closed position until the flush valve has closed completely, at which time the float ball is lowered and water is let in to the tank.

2 Claims, 2 Drawing Sheets

WATER CONSERVING TOILET ASSEMBLY

This application is a continuation of application Ser. No. 07/367229 filed Jun. 14, 1989 now abandoned.

BACKGROUND OF THE INVENTION

Toilet flushing devices that minimize water loss by controlling the operation of the float valve have been know to the art. Some of these include U.S. Pat. Nos. 4,110,849; 4,399,845; and 4,351,071. However none of these provide for the possibility of the flush valve not closing. If the flush valve is not completely closed, water will continue to run out of the tank through the flush valve as water runs into the tank from the intake valve (since the float ball was lowered when the tank level went down). The present invention alleviates this problem by insuring that the float ball will not fall until the flush valve has closed. This insures the proper closing of the flush valve before the float opens the intake valve.

SUMMARY

Attached to the flush valve is a counter-weight capable of filling with water. A controller arm is connected to the float ball arm and rests against this counter-weight. When the toilet is flushed, the lifting of the handle lifts the flush valve up and the valve remains in the up position until the counter-weight has run out of water. The controller arm float ball arm keeps the float arm in the closed "up"position until all the water has left the tank. After the counter-weight empties of water, the flush valve falls back down and closes, the controller arm is lowered, the float ball arm and float ball are lowered, and the intake valve allows the water to fill the tank. Thus the amount of water that can escape during any one flush is limited to the capacity of the tank, water will not be lost because the flush valve is open while the tank is refilling. Since conventional intake valves opens at the start of the flush, as much as 20% of a normal flush can be saved by using this device.

Another objective is to prevent the loss of a great amount of water in the event that the flush valve had remained open for a length of time.

It is among the objectives of this invention to prevent water from running out continuously during the flushing operation if the flush value inadvertently stays open, i.e. to prevent the ingress of water until the flush valve is completely closed.

Another is to devise a water-saving device that is simple and able to be retrofitted into existing tank assemblies.

Still another, is to create an inexpensive water-saving device.

DESCRIPTION OF THE INVENTION

Figure 1:
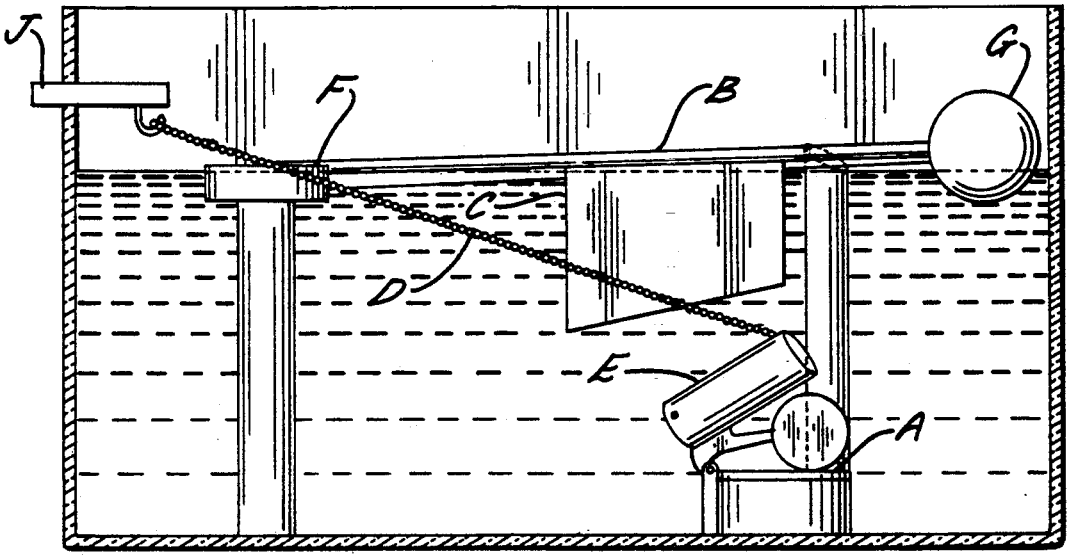
FIG. 1 shows the tank in the normal, "at rest" position. The tank is completely filled.
Figure 2:
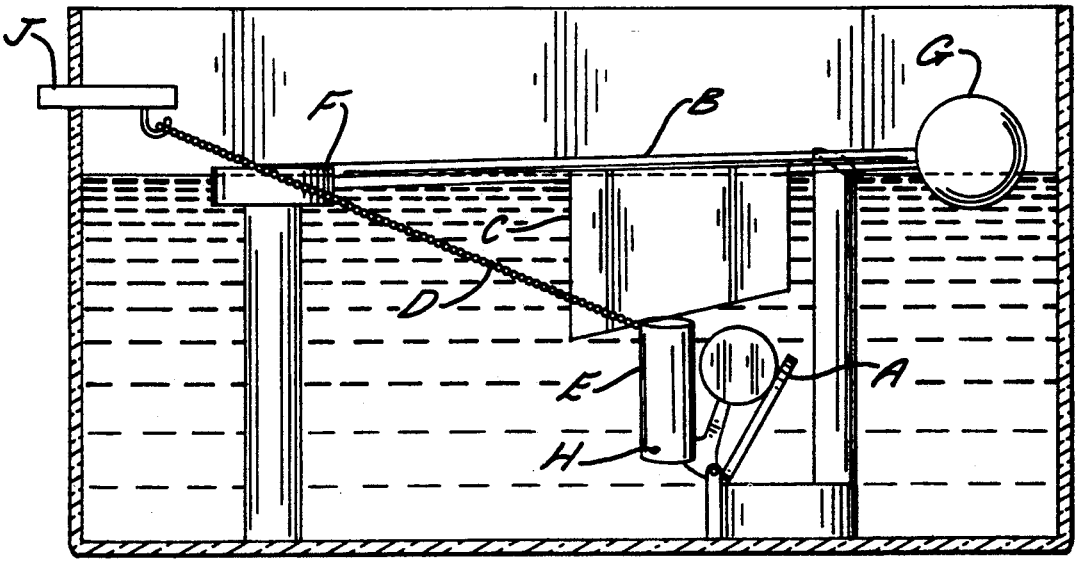
FIG. 2 shows the position at the start of the flush.

When the tank is full (FIG. 1), A (the flush valve) is in the closed position, controller arm C is attached to the float arm, B. It extends downward so that it rests against the top of the counter-weight when the counter-weight is pivoted upright upon initial flushing, see FIG. 2. The float ball G floats freely on the surface of the water. FIG. 2 shows the beginning of the flush cycle where flush valve A is pulled open by the external handle J. The counter-weight E which is connected to the flush valve rises up to meet C and thus holds the float arm B in the up position which disallows water from entering the flush tank initially. The counter-weight E (a cylinder that holds water for a time until it escapes through hole H) is raised up to the position in FIG. 2 and thus holds the flush valve open for a time thus allowing the toilet to flush before the float ball comes down.

The counter-weight E is a cylinder with a hole near the bottom that is capable of holding water when the toilet is flushed. As shown in FIG. 2, the cylinder is now in an upright position upon the initial flush and as such it is filled with water. The function of the counter-weight E is to hold open the flush valve A and to support the float arm B. This it does until the water in the cylinder has emptied through the hole F in the bottom of the cylinder.

When the counter-weight E falls, the flush valve A closes, the controller arm C is lowered simultaneously and arm B is allowed to fall freely down and allow water to refill the flush tank. This action prevents water from entering the tank until the flush valve is closed. This is because the intake valve F is triggered by the falling of the float ball and arm (G and B) which does not happen when the water falls, but when the flush valve falls.

Figure 3:
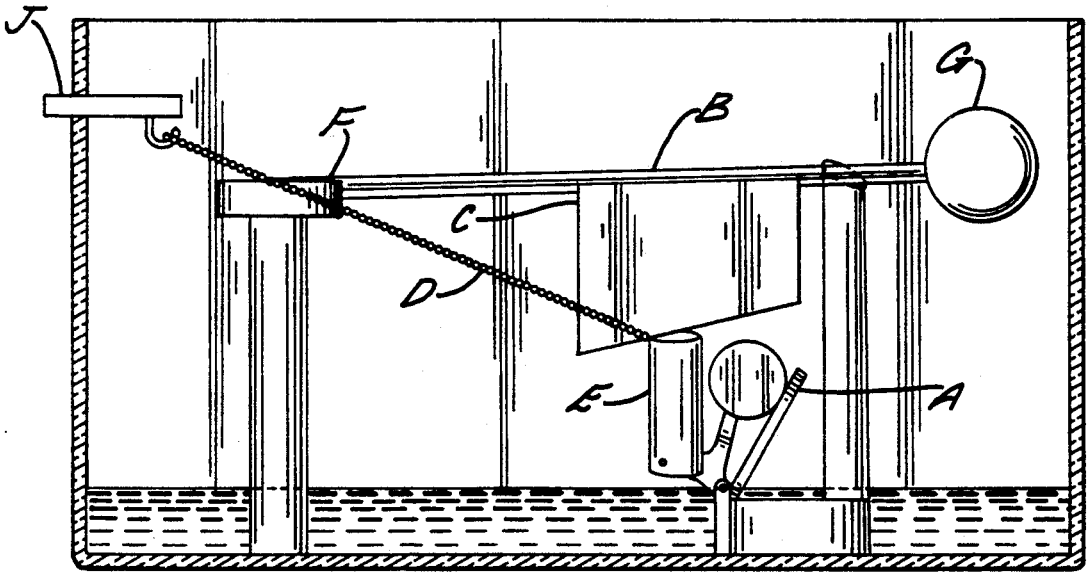
FIG. 3 shows the drop in the water level while the float ball remains in the up position.
Figure 4:
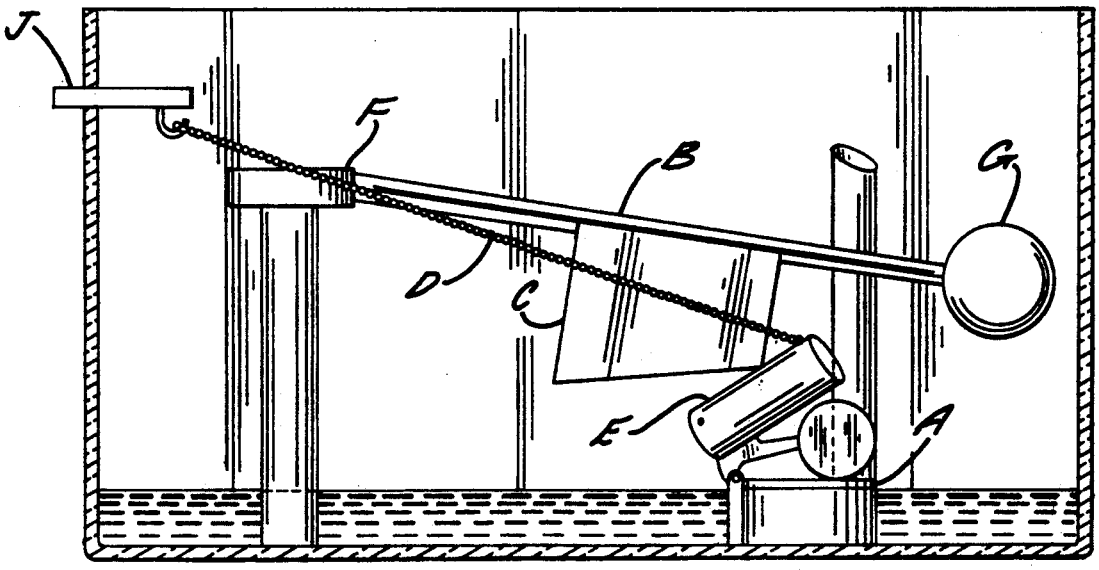
FIG. 4 shows the lowering of the float ball after the flush valve has closed.

In FIG. 3 the flush tank has emptied but cup E has not, this illustrates the unique position that this invention has achieved, the intake valve has not yet begun to fill although the tank has been emptied. FIG. 4 shows the next step, the water has flowed out of the counter-weight and the flush valve has closed thus lowering the float ball and opening the intake valve. This is an ideal time to allow water to begin filling the tank since (1) the flush tank is empty, and (2) the flush valve is closed. This system guarantees that the tank will not begin refilling until the flush valve has closed. As the water fills the tank, the rest state, as shown in FIG. 1 is reestablished. Of course any device that holds up the flush valve for a certain length of time may be used and the spirit of the invention not violated. The weight shown here, a cup with a hole in the bottom, may be made with any material and is used as a simple, inexpensive means of achieving this step in the process of saving water. Note also that the controller arm C does not have to be attached to the float arm B but could go on the flush valve, any system that provides for the controller to go up with the flush valve will do.

This version with the counter-weight, is preferred because it allows in a simple way for the weight of arm B and float to be compensated for by the size (water capacity) of cup E. Otherwise measures might have to be taken to reduce the weight of the arm B assembly. Of course, the rest of the articles are of ordinary availability and other materials could be substituted for them. In fact, any arrangement of articles that achieves these steps can be used.

Alternative embodiments would include possibly a more buoyant "A" to provide more lift for arm, B and the float ball G being constructed of a lighter material that does not compromise strength and inertness to the moist environment.

I claim:

1. A water saving toilet apparatus for operation within the water tank of a toilet having a flush valve, a flush handle and a float ball, said apparatus comprising:

a counter-weight connected to said flush handle of said toilet, said counter-weight comprising a cylindrical shaped portion having an opening near the top and a bottom wall at the bottom of said cylindrical portion, said bottom wall having a hole, said counter-weight adapted to be pivotally attached to said flush valve near the bottom of said toilet tank so that said counter-weight is capable of moving from a relatively horizontal position to a relatively upright position within said toilet tank, so that said counter-weight can hold water for a time in said relatively upright position, said counter-weight in connection with said flush valve of said toilet so that said flush valve is in a closed position when cylinder is in a relatively horizontal position and said flush valve is in an open position when said counter-weight is in an upright position, so that said counter-weight is capable of being raised to an upright position upon movement of said flush handle and said flush valve is capable of being opened by said movement of said flush handle, said counter-weight capable of remaining in said upright position for a time and of holding said flush valve in an open position until said counter-weight has been emptied of water so that said emptying of said water through said counter-weight takes a longer time to occur than the time it takes said flush valve to empty said tank, said float ball connected to a controller arm, said controller arm connected to an inlet valve capable of filling said toilet tank with water upon the downward movement of said float ball, said controller arm having a downwardly projecting portion, said downwardly projecting portion capable of contacting said counter-weight when said counter-weight is in said upright position so that said counter-weight supports said float ball through said downwardly projecting portion and said controller arm and delays the filling of said toilet tank by said inlet valve until said counter-weight has substantially emptied of water.

2. The apparatus of claim 1 wherein said downwardly projecting portion is of substantially narrow width.

* * * * *